US006816133B2

(12) United States Patent
Tsai

(10) Patent No.: US 6,816,133 B2
(45) Date of Patent: Nov. 9, 2004

(54) DRIVING METHOD OF PLASMA DISPLAY PANEL AND CIRCUIT THEREOF

(75) Inventor: Chung-Kuang Tsai, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 234 days.

(21) Appl. No.: 10/041,448

(22) Filed: Jan. 10, 2002

(65) Prior Publication Data

US 2002/0089472 A1 Jul. 11, 2002

(30) Foreign Application Priority Data

Jan. 11, 2001 (TW) ..... 90100657 A

(51) Int. Cl.[7] ..... Q09G 3/28
(52) U.S. Cl. ..... 345/60; 345/62; 345/68
(58) Field of Search ..... 345/60, 62, 67, 345/68; 315/169.1, 169.4

(56) References Cited

U.S. PATENT DOCUMENTS 6,020,687 A * 2/2000 Hirakawa et al. ..... 385/135
6,072,449 A 6/2000 Amemiya
6,118,220 A * 9/2000 Shino et al. ..... 315/169.4
6,236,165 B1 * 5/2001 Ishizuka ..... 315/169.1
6,323,830 B1 * 11/2001 Huang ..... 345/68
6,344,841 B1 * 2/2002 Moon ..... 345/60
6,531,995 B2 * 3/2003 Ishii et al. ..... 345/67
6,559,814 B1 * 5/2003 Kanazawa et al. ..... 345/60
6,587,084 B1 * 7/2003 Alymov et al. ..... 345/60

* cited by examiner

*Primary Examiner*—Guy J. Lamarre
*Assistant Examiner*—Fritz Alphonse
(74) *Attorney, Agent, or Firm*—Rabin & Berdo, P.C.

(57) ABSTRACT

A driving method of a plasma display panel and a driving circuit thereof are disclosed. In the method, image data is inputted by applying a scanning pulse to the scanning electrode and selectively applying a data pulse to the data electrode during an address period. Then, a first pulse and a second pulse of different phase are respectively applied to the first sustaining electrode and the second sustaining electrode during a sustain period. A third pulse is applied to the scanning electrode to sustain the image data. A first discharge current and a second discharge current are occurred, an time interval is formed between the discharge currents to reduce an instant power consumption of the PDP. The driving method is also used to reduce the electromagnetic interference and increases the operation margin.

5 Claims, 15 Drawing Sheets

DRIVING METHOD OF PLASMA DISPLAY PANEL AND CIRCUIT THEREOF

This application incorporates by reference Taiwanese application Serial No. 90100657, filed Jan. 11, 2001.

BACKGROUND OF THE INVENTION

1. Field of the Invention

This invention relates to a driving method for a plasma display panel (hereinafter referred to as PDP) and a circuit thereof, particularly to a driving method for reducing a voltage difference of the sustaining electrode and circuit thereof.

2. Description of the Related Art

Please refer to FIG. 1, it shows a cross-sectional view of a conventional PDP structure. There are several sustaining electrodes X and scanning electrodes Y alternately disposed on the surface of the front glass substrate 102 and are parallel to each other. Each of the sustaining electrode X or scanning electrode Y comprises a transparent electrode 106 and an auxiliary electrode 108. The auxiliary electrode 108 is used to increase the conductivity of the transparent electrode 106. A dielectric layer 110 is positioned on the transparent electrode 106 and the auxiliary electrode 108, and a protective layer 112 covers the dielectric layer 110.

A plurality of address electrodes 114, which are perpendicular to the sustaining electrodes X and the scanning electrodes Y, are positioned on the surface of the rear glass substrate 104. Each address electrode 114 is formed below a fluorescent layer 116 and ribs (not shown in FIG. 1). The discharge space 118 is formed between the protective layer 112 and the fluorescent layer 116. The discharge space is filled with discharge gas, for instance, inert gases.

Referring to FIG. 2, it is the diagram of the electrode arrangement of the conventional PDP. The sustaining electrode X and the scanning electrode Y are alternately disposed, that is, these electrodes are arranged by the order of scanning electrode Y(1), sustaining electrode X(1), scanning electrode Y(2) and sustaining electrode X(2). The address electrodes A(1), A(2), A(3) and A(4) are perpendicular to the sustaining electrodes X and the scanning electrodes Y. Each discharge cell E1, can be turned on and off, is defined by the sustaining electrode X, scanning electrode Y and address electrode A.

Referring to FIG. 3, it is the diagram showing another electrode arrangement of the conventional PDP. The sustaining electrode X and the scanning electrode Y are arranged by the order of YXXY, that is, the electrodes are arranged by the order of the scanning electrode Y(1), sustaining electrode X(1), sustaining electrode X(2) and the scanning electrode Y(2). The address electrode A(1), A(2), A(3) and A(4) are perpendicular to the sustaining electrodes X and the scanning electrodes Y. Each discharge element E2, can be selectively turned on and off, is defined by each sustaining electrode X, scanning electrode Y and address electrode A.

Referring to FIG. 4, it is the diagram of the driving waveform for driving the conventional PDP in FIG. 2 or FIG. 3. In this driving method, there are three periods in each subfield, including a reset period P1, an address period P2, and a sustain period P3. The following description is the operation of a PDP having n sustaining electrodes X(1)~X(n), n scanning electrodes Y(1)~Y(n) and m address electrodes A(1)~A(m).

To make sure that the data can be addressed correctly in the pixels, in the reset period P1, a priming pulse 402 of 340V is applied to the sustaining electrodes X(1)~X(n), and an erase pulse 404 with a positive voltage, a reset pulse 406 with a negative voltage and a stabilizing priming pulse 408 are sequentially applied to the scanning electrodes Y(1)~Y(n). The wall charges of the discharge cells are reset to a certain energy state by the pulses described above. Those pulses also reduce the ionized charges in the discharge space 118.

During the address period P2, lots of scanning pulses 410 of −180V are inputted to the scanning electrodes Y(1)~Y(n). A voltage V1, about 60V, is applied to the sustaining electrodes X(1)~X(n). According to the image data to be displayed, the address pulse 412 of 60V is selectively inputted to the address electrodes A(1)~A(m) for producing wall charges. Therefore, the wall charges can be increased in the selected discharge cells, and are used as the initial charges for a subsequent sustain period P3.

During the sustain period P3, the discharge cells emit UV light and the user will see visible light as UV photons hit the fluorescent layer 116. By the memory effect of the wall charges, the discharge cells are lighted after applying an alternating current with opposite polarities to the scanning electrodes Y(1)~Y(n) and the sustain electrodes X(1)~X(n). The signals applied to the scanning electrodes Y(1)~Y(n) and the sustain electrodes X(1)~X(n), are in a range between 180V and 0V, and these signals include a plurality of discharge sustaining pulse 414.

Please refer to FIG. 5 which is a block diagram of the circuit and used to drive the conventional PDP in FIG. 2 or FIG. 3. Take n=8 as an example. The Y driving circuit 502 includes a reset/scan circuit 504 and a Y sustaining circuit 506. The reset/scan circuit 504 should provide at lease one signal with a positive voltage and one signal with a negative voltage, so the reset/scan circuit 504 is a positive/negative polarity circuit. During the reset period P1 or the address period P2, the reset/scan circuit 504 provides signals with voltages of 180V, −90V or −180V to the scanning electrodes Y. During the sustain period P3, the sustaining circuit 506 provides signals with voltages of 180V or 0V to the scanning electrodes Y. During the address period P2 and the sustain period P3, the Y driving circuit 502 provides the signals to the multiplexer 508 and the scanning IC 510 which is electrically connected to all of the scanning electrodes Y(1)~Y(8). The scanning IC 510 sequentially outputs the scanning pulse 410 to the scanning electrodes Y(1)~Y(8) during the address period P2, and simultaneously provides discharge sustaining pulses 414 to the scanning electrode Y(1)~Y(8) during the sustain period P3. Moreover, all of the sustaining electrodes X are coupled to the X driving circuit 514. The X driving circuit 514 includes a reset circuit 516 and a X sustaining circuit 512. The reset circuit 516 only provides signals with a positive voltage, so the reset circuit 516 is a positive polarity circuit.

Referring to FIG. 6, it shows the current IX of the sustaining electrode X, and the voltage of the sustaining electrode X and the scanning electrode Y during the sustain period P3 in FIG. 4. After the discharge sustaining pulse 414 is applied, the discharge cell is discharged, and a current Ids will pass through the sustaining electrode X, scanning electrode Y, X sustaining circuit 512 and Y sustaining circuit 506. The X sustaining circuit 512 and the Y sustaining circuit 506 include a lot of transistors, every transistor has its resistance, and the total resistance of these transistors is defined as Rds. When the current Ids is formed, a voltage difference V=Ids*Rds is occurred within a very short time because of the resistances Rds of these transistors. When the electric current flows out of one electrode, the voltage difference V is negative, and a notch may appear in the voltage waveform of the electrode. When the electric current flows in the electrode, the voltage difference V is positive, and a peak may appear in the voltage waveform of the electrode. In addition, whether a notch or a peak is formed may depend on the signals applied on these electrodes. When the sustaining electrode X is in a positive voltage (e.g. 180V) and the scanning electrode is in a relative negative voltage (e.g. 0V), the instant voltage difference V cause a voltage notch 602*a* in the voltage waveforms of the sustaining electrode X and a peak 602*b* in the voltage waveforms of the scanning electrode Y. The voltage difference V can be as higher as 60V. Therefore, the actual voltage waveforms of the sustaining electrode X and the scanning electrode Y are different from these of the inputted signals of the driving circuits. The voltage operation margin of the PDP is then reduced, and the electromagnetic radiation interference (EMI) becomes seriously when the notch or the peak is formed.

U.S. Pat. No. 6,072,449 discloses a method for driving the PDP and a method can reduce the instant voltage difference V. The voltage and the current waveforms for the sustaining electrode X and the scanning electrode Y are shown in FIG. 7. First, the scanning electrodes Y are divided to two groups including first scanning electrodes Y1 and second scanning electrodes Y2. Take a first scanning electrode Y1 and a second scanning electrode Y2 as the example, the discharge sustaining pulses with different phases are applied, respectively. Therefore, on the sustaining electrode X, the displacement current 702 caused by the voltage difference of the first scanning electrode Y1, the displacement current 702' caused by the voltage difference of the sustaining electrode X, the discharge current 704 of the sustaining electrode X and the first scanning electrode Y1, the displacement current 706 caused by the voltage difference of the second scanning electrode Y2, and the discharge current 708 of the sustaining electrode X and the second scanning electrode Y2 will appear at different times. Therefore, the discharge currents 704, 708 become smaller. According to the above-mentioned equation V=Ids*Rds, the instant voltage difference can be reduced when the current is reduced. The voltage notches 710, 712 or peaks 714, 716 formed by the instant voltage difference V can also be reduced. However, the circuit is very complex, and thereby the cost is very high.

Referring to FIG. 8, it shows the block diagram of the driving circuit to produce the waveform in FIG. 7. The first scanning electrode Y1 and the second scanning circuit Y2 are respectively coupled to the scanning IC 810 and the scanning IC 820. There are many transistors in the Y driving circuit 802, so the scanning ICs 810, 820 can't couple to only one Y driving circuit 802. Every scanning IC must couple to a corresponding Y driving circuit to output a different driving waveform. Therefore, the scanning ICs 810 and 820 are respectively coupled to the Y driving circuits 802 and 812 through the multiplexer 808 and 818. The Y driving circuit 802 includes a reset/scan circuit 804 and a Y sustaining circuit 806, and the Y driving circuit 812 includes a reset/scan circuit 814 and a Y sustaining circuit 816. The reset/scan circuits 804, 814 are negative/positive polarity reset circuits. A X driving circuit 826 includes a reset circuit 828 and a X sustaining circuit 824. Moreover, the Y driving circuits 802 and 812 respectively receive control signals C_Y(1) and the C_Y(2) from the phase shift controller 822 to produce different discharge sustaining pulses. The phase shift controller 822 further transmits one control signal C_X(1) to the X sustaining circuit 824 to maintain the synchronization of the sustaining circuit 806, 816 and 824. However, there are so many components in the above-mentioned circuit, the prior circuit would be very complicated and the manufacturing cost is high.

SUMMARY OF THE INVENTION

From the above description, the object of the present invention is to provide a driving method of a Plasma Display Panel (PDP)and circuit thereof. The driving method and circuit of the PDP reduces the voltage difference effectively and increases the operation margin. Especially, the driving method reduces the electromagnetic interference of the PDP efficiently. The object of the present invention is achieved with only a simple circuit.

According to the object of the present invention, a driving method of the PDP is disclosed. The PDP includes a first sustaining electrode, a second sustaining electrode, a scanning electrode and a data electrode. The scanning electrode is parallel to the first sustain electrode and the second sustain electrode. The data electrode is perpendicular to the first sustaining electrode. The driving method includes steps of: (a) providing an address period, (b) applying a scanning pulse to the scanning electrode during the address period and selectively applying a data pulse to the data electrode for writing in an image data, (c) providing a sustain period, and (d) applying a first pulse and a second pulse with different phases to the first sustaining electrode and the second sustaining electrode, and applying a third pulse to the scanning electrode for maintaining the image data. The first pulse and the second pulse produce a first discharge current and a second discharge current on the first sustaining electrode and the second sustaining electrode, and an time interval is formed between the second discharge current and the first discharge current to reduce an instant power consumption of the PDP.

According to another object of the present invention, a PDP driving circuit is also disclosed. The PDP includes a scanning electrode, a first sustaining electrode, a second sustaining electrode and a data electrode. The scanning electrode is parallel to the first sustain electrode and the second sustain electrode. The data electrode is perpendicular to the first sustaining electrode. The driving circuit of the PDP includes a Y driving circuit, a scanning IC, a first X sustaining circuit, a second X sustaining circuit and a phase shift controller. The scanning IC is coupled to the scanning electrode and the Y driving circuit. The first X sustaining circuit is coupled to the first sustaining electrode X1, and the second X sustaining circuit is coupled to the second sustaining electrode X2. The phase shift controller is coupled to the first X sustaining circuit and the second X sustaining circuit, the phase shift controller is commanded the first X sustaining circuit and the second X sustaining circuit to output a first and a second pulse, and the first and second pulse are in different phases.

BRIEF DESCRIPTION OF THE DRAWINGS

The above objects and other advantages of the present invention will become more apparently by describing in detail the preferred embodiment of the present invention with reference to the attached drawings in which.

DESCRIPTION OF THE PREFERRED EMBODIMENTS

In the present invention, the sustaining electrodes X are divided into two groups, including the first sustaining electrodes X1 and the second sustaining electrodes X2. The scanning electrodes Y are also divided into two groups including the first scanning electrodes Y1 and the second electrodes Y2. Take a first sustaining electrode, a second sustaining electrode, a first scanning electrode, and a second scanning electrode as the example in the follow description.

During the sustain period P3, the first and second discharge sustaining pulses with different phases are applied to the first sustaining electrode X1 and the second sustaining electrode X2, respectively. The third discharge sustaining pulse is applied to the first scanning electrode Y1 and the second scanning electrode Y2. Thus, the first discharge current and the second discharge current are outputted from the first sustaining electrode X1 and the second sustaining electrode X2. The second discharge current appears after the first discharge current for a delay time. The instant power consumption of the PDP is reduced and the voltage differences (notches or peaks) of the first sustaining electrode X1, the second sustaining electrode X2, the first scanning electrode Y1 and the second scanning electrode Y2 are also reduced.

Figure 9:
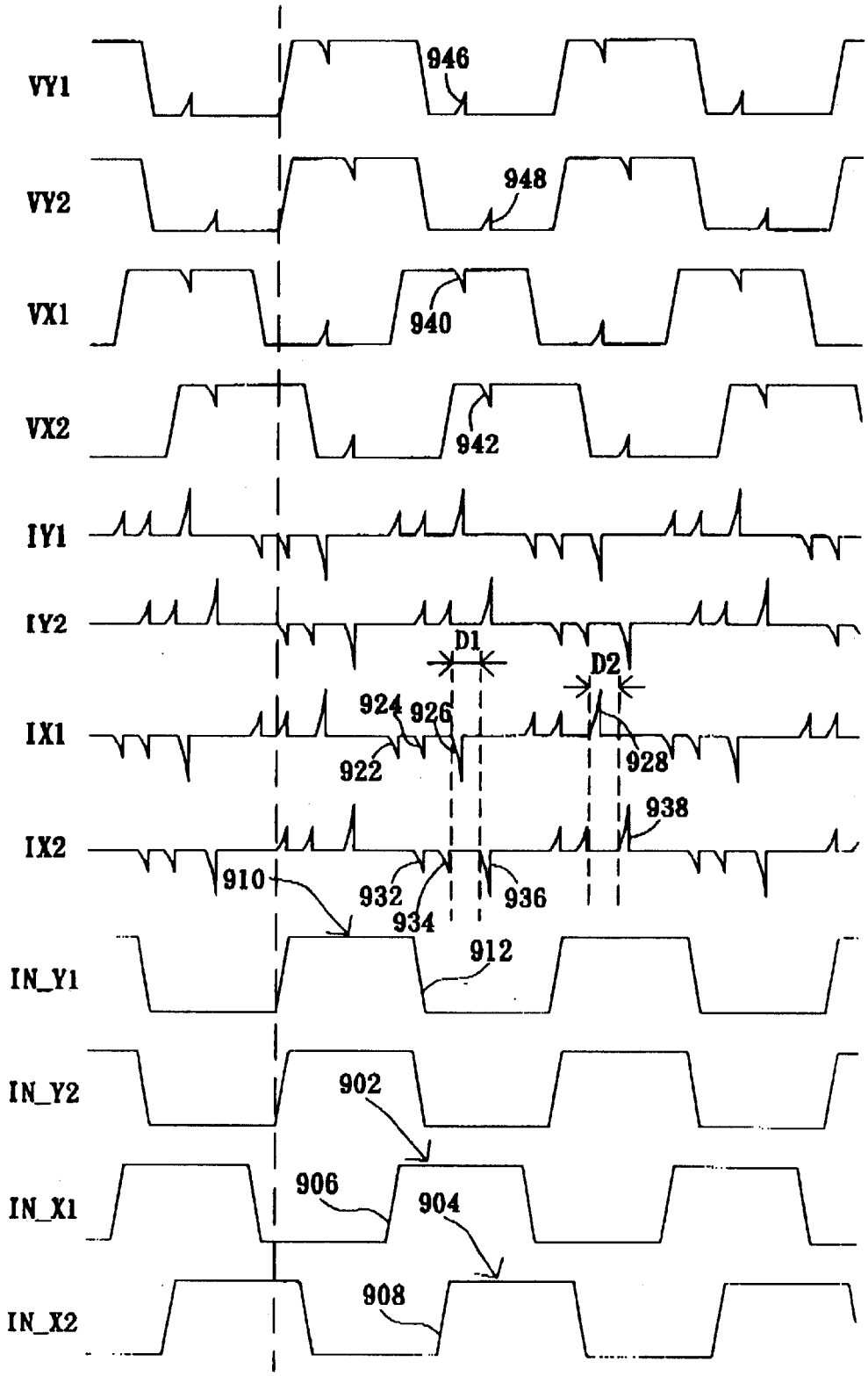
FIG. 9 shows the current waveforms of the first sustaining electrode X1, the second sustaining electrode X2, the first scanning electrode Y1 and the second scanning electrode Y2 according to the preferred embodiment in the present invention.

Referring to FIG. 9, it shows the voltage and current waveforms of the first sustaining electrode X1, the second sustaining electrode X2, the first scanning electrode Y1 and the second scanning electrode Y2 in the preferred embodiment. Several sustaining signals IN_Y1, IN_Y2, IN_X1 and IN_X2 are inputted from the outer circuits (not shown) to the first scanning electrode Y1, the second scanning electrode Y2, the first sustaining electrode X1, the second sustaining electrode X2, respectively. Then, the voltage waveforms of the first scanning electrode Y1, the second scanning electrode Y2, the first sustaining electrode X1, the second sustaining electrode X2 are shown as VY1, VY2, VX1, VX2. The current waveforms of the first scanning electrode Y1, the second scanning electrode Y2, the first sustaining electrode X1, the second sustaining electrode X2 are shown as IY1, IY2, IX1, IX2, respectively.

In FIG. 9, the first discharge sustaining pulse 902 applied to the first sustaining electrode X1 and the second discharge sustaining pulse 904 applied to the second sustaining electrode X2 have different phases. Therefore, the first rising edge 906 of the first discharge sustaining pulse 902 and the second rising edge 908 of the second discharge sustaining pulse 904 are staggered. The first rising edge 906 appears before the falling edge 912 of the third discharge sustaining pulse 910. The second rising edge 908 appears after the falling edge 912 of the third discharge sustaining pulse 910. The third discharge sustaining pulse 910 is the signal inputted to the first scanning electrode Y1 and the second scanning electrode Y2.

As voltage differences of the first sustaining electrode X1 and the first scanning electrode Y1 happen, first displacement currents 922 and 924 are generated. A first discharge current 926 will appear when the voltage difference between the first sustaining electrode X1 and the first scanning electrode Y1 is larger than a threshold voltage. Moreover, as voltage differences of the second sustaining electrode X2 and the second scanning electrode Y2 happen, second displacement currents 932 and 934 appear. A second discharge current 936 will be generated if the voltage difference between the second sustaining electrode X2 and the second scanning electrode Y2 is larger than the threshold voltage.

The first discharging current 926 and the second discharging current 936 are staggered because the phases of the first sustain discharging pulse 902 and the second sustain discharging pulse 904 are different. A delay time D1 is formed between the second discharging current 936 and the first discharging current 926. Therefore, the instant power consumption of the PDP can be reduced. The voltage differences (notches or peaks) 940, 942, 946, 948 of the first sustaining electrode X1, the second sustaining electrode X2, the first scanning electrode Y1 and the second scanning electrode Y2 can be reduce, and so as the electromagnetic interference (EMI) do.

Figure 10:
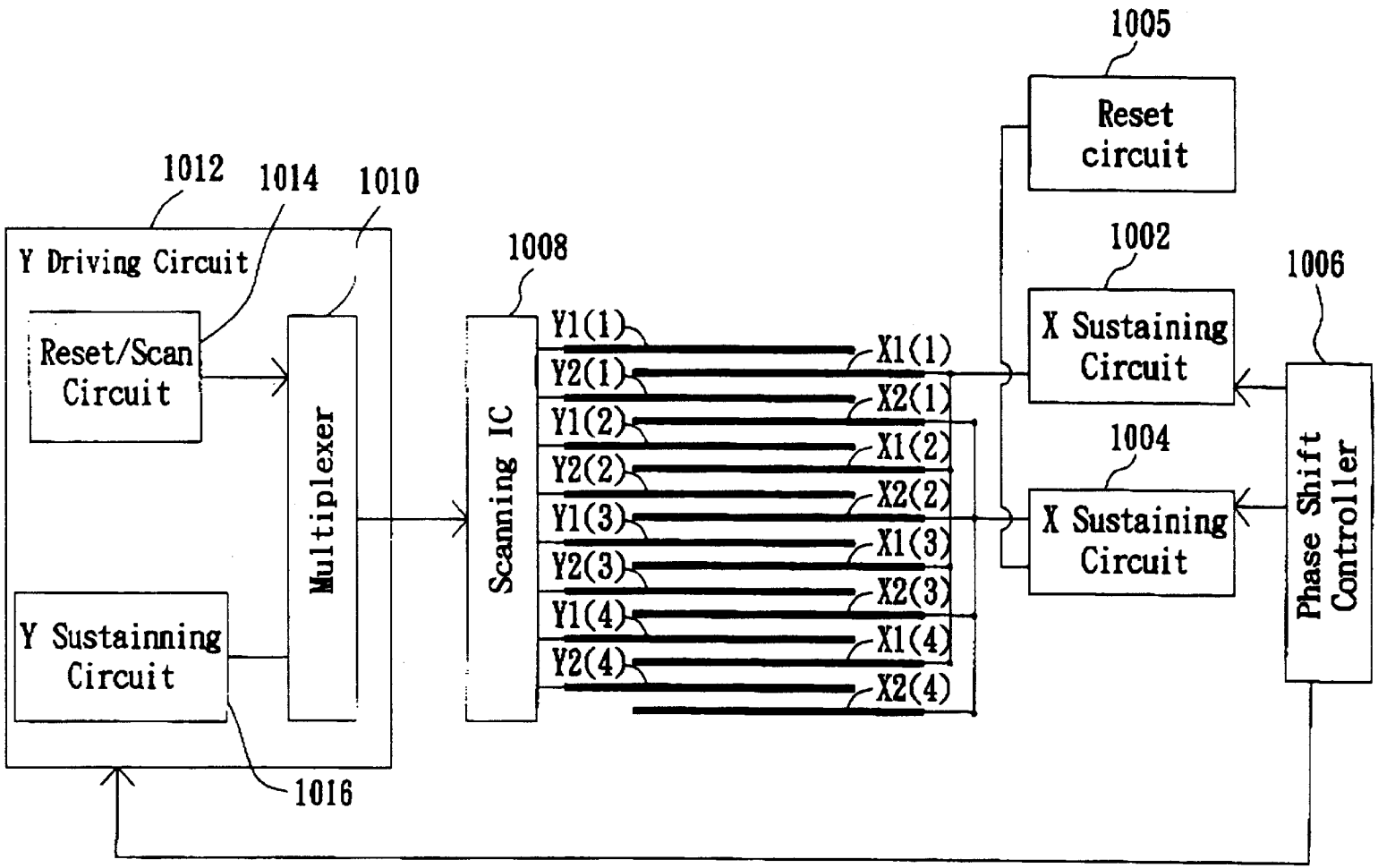
FIG. 10 shows the block diagram of a driving circuit used for a PDP having the YXYX-type electrode arrangement according to the preferred embodiment in the present invention.

In FIG. 10, it shows the block diagram of the driving circuit used in the PDP having a YXYX-type electrode arrangement according to the preferred embodiment in the present invention. The sustaining electrodes X are divided into two groups, including a first sustaining electrodes X1 and a second sustaining electrodes X2. Those electrodes are alternately disposed. For example, the first sustaining electrodes X1 include the first sustaining electrode X1(1), X1(2), X1(3), X1(4), and the second sustaining electrodes X2 include the second sustaining electrode X2(1), X2(2), X2(3) and X2(4). All first sustaining electrodes X1 are coupled to the first sustaining circuit 1002, and all second sustaining electrodes X2 are coupled to the second X sustaining circuit 1004. These X sustaining circuits 1002 and 1004 are used to provide the driving waveforms. Furthermore, a phase shift controller 1006 is coupled to the first X sustaining circuit 1002 and the second X sustaining circuit 1004 to provide the first discharge sustaining pulse 902 to the first X sustaining circuit 1002 and provide the second discharge sustaining pulse 904 to the second X sustaining circuit 1004. The first and second discharge sustaining pulses 902, 904 are in different phases. Only one reset circuit 1005 is coupled to the first X sustaining circuit 1002 and the second X sustaining circuit 1004. The reset circuit 1005 is a positive polarity reset circuit.

The first scanning electrode Y1 and the second scanning electrode Y2 are both coupled to the scanning IC 1008, and the scanning IC 1008 is further connected with the multiplexer 1010 of the Y driving circuit 1012. The Y driving circuit 1012 includes a reset/scan circuit 1014 and a Y sustaining circuit 1016. The reset/scan circuit 1014 is a negative/positive polarity reset circuit. During the reset period P1 and the address period P2, the reset/scan circuit 1014 provides a voltage, for instance 180V, −90V or −180V, to the first scanning electrode Y1 and the second scanning electrode Y2. During the sustain period P3, the Y sustaining circuit 1016 provides a voltage of 180V or 0V to the first scanning electrode Y1 and the second scanning electrode Y2.

By a control signal (not shown in FIG. 10), the Y sustain scanning driving circuit 1012 provides different driving signals to the first scanning electrode Y1 and the second scanning electrode Y2 during the address period P2 and the sustain period P3. These driving signals are transmitted to the scanning IC 1008 via the multiplexer 1010.

During the address period P2, scanning pulses are outputted to the first scanning electrodes Y1(1)~Y(4) and the second scanning electrodes Y2(1)~Y2(4) in order by the scanning IC 1008. During the sustain period P3, several sustain discharging pulses 910 are applied to the first scanning electrode Y1(1)~Y1(4) and the second scanning electrode Y2(1)~Y2(4) by the scanning IC 1008 simultaneously.

Figure 11:
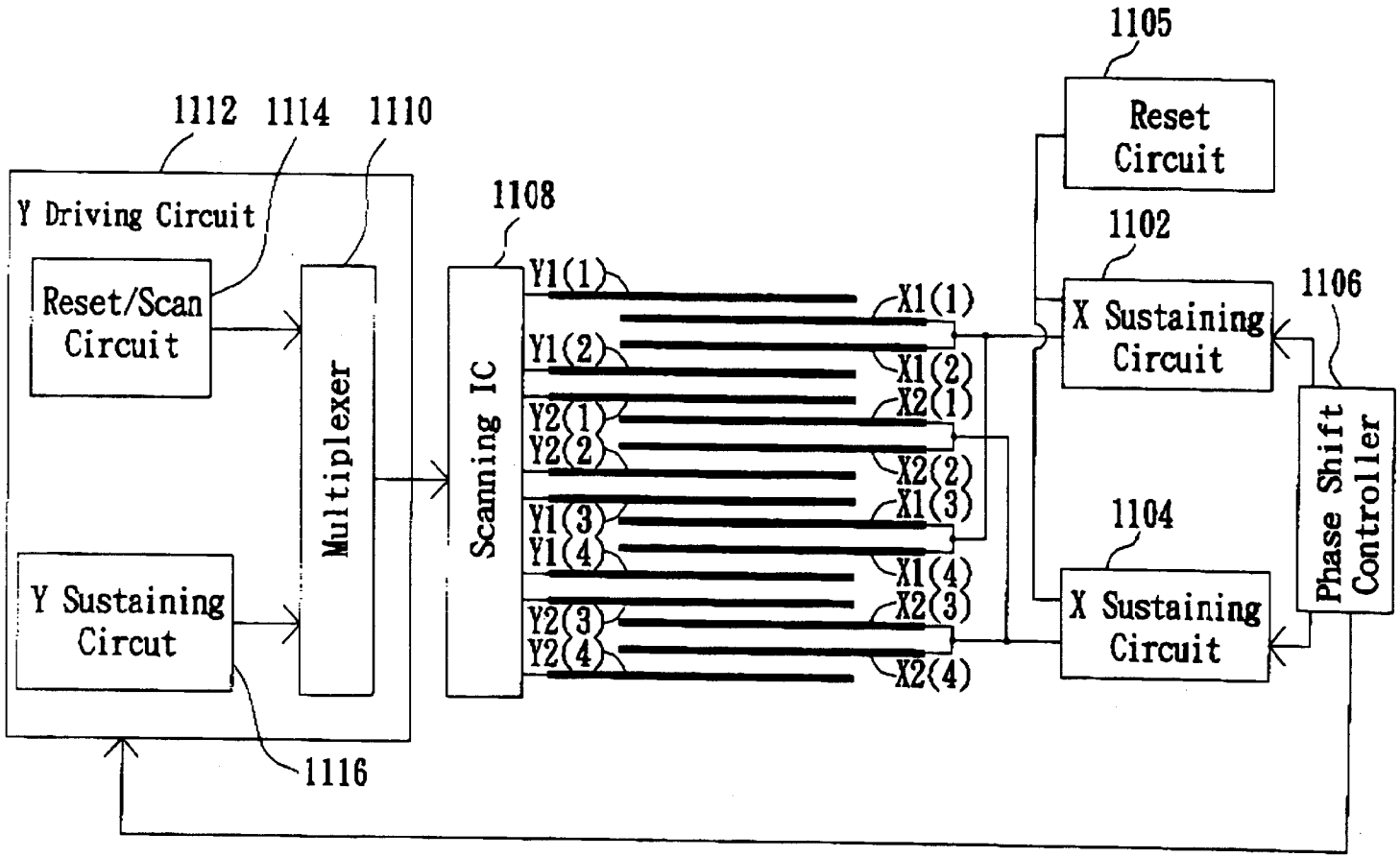
FIG. 11 shows block diagram of a driving circuit used for a PDP having the YXXY-type electrode arrangement according to the preferred the embodiment in the present invention.

Please refer to FIG. 11, it shows the block diagram of another driving circuit used in the PDP having a YXXY-type electrode arrangement in the present invention. The sustaining electrodes X are divided into two groups, including a first sustaining electrodes X1 and the second sustaining electrodes X2. The scanning electrodes Y are divided into two groups, including first scanning electrodes Y1 and second scanning electrodes Y2. For example, the first sustaining electrodes X1 include the first sustaining electrode X1(1), X1(2), X1(3), X1(4), the second sustaining electrodes X2 include the second sustaining electrode X2(l), X2(2), X2(3) and X2(4), the first scanning electrodes Y1 include the first scanning electrode Y1(1), Y1(2), Y1(3), Y1(4), and the second scanning electrodes Y2 include the second scanning electrode Y2(1), Y2(2), Y2(3) and Y2(4). These electrodes are arranged by the order of Y(1), X1(1), X1(2), Y1(2), Y2(l), X2(1), X2(2), Y2(2), Y3(l), . . . etc. Meanwhile, all first sustaining electrodes X1 are coupled to a first X sustaining circuit 1102, and all second sustaining electrodes X2 are coupled to a second X sustaining circuit 1104. The phase shift controller 1106 is coupled to the first X sustaining circuit 1102 and the second X sustaining circuit 1104. Only one reset circuit 1105 is coupled to the first X sustaining circuit 1002 and the second X sustaining circuit 1004.

Figure 1:
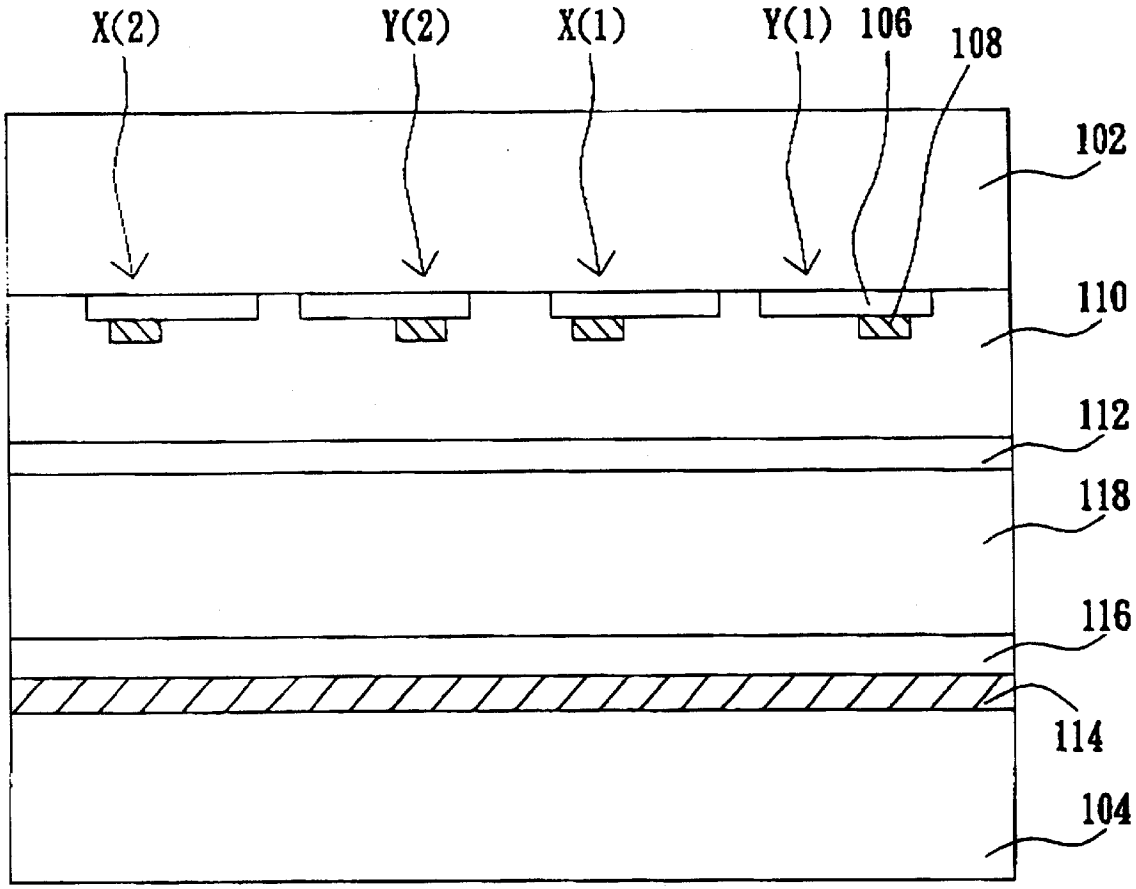
FIG. 1 (PRIOR ART)
FIG. 1 is the cross section showing the conventional structure of a Plasma Display Panel (PDP)
Figure 2:
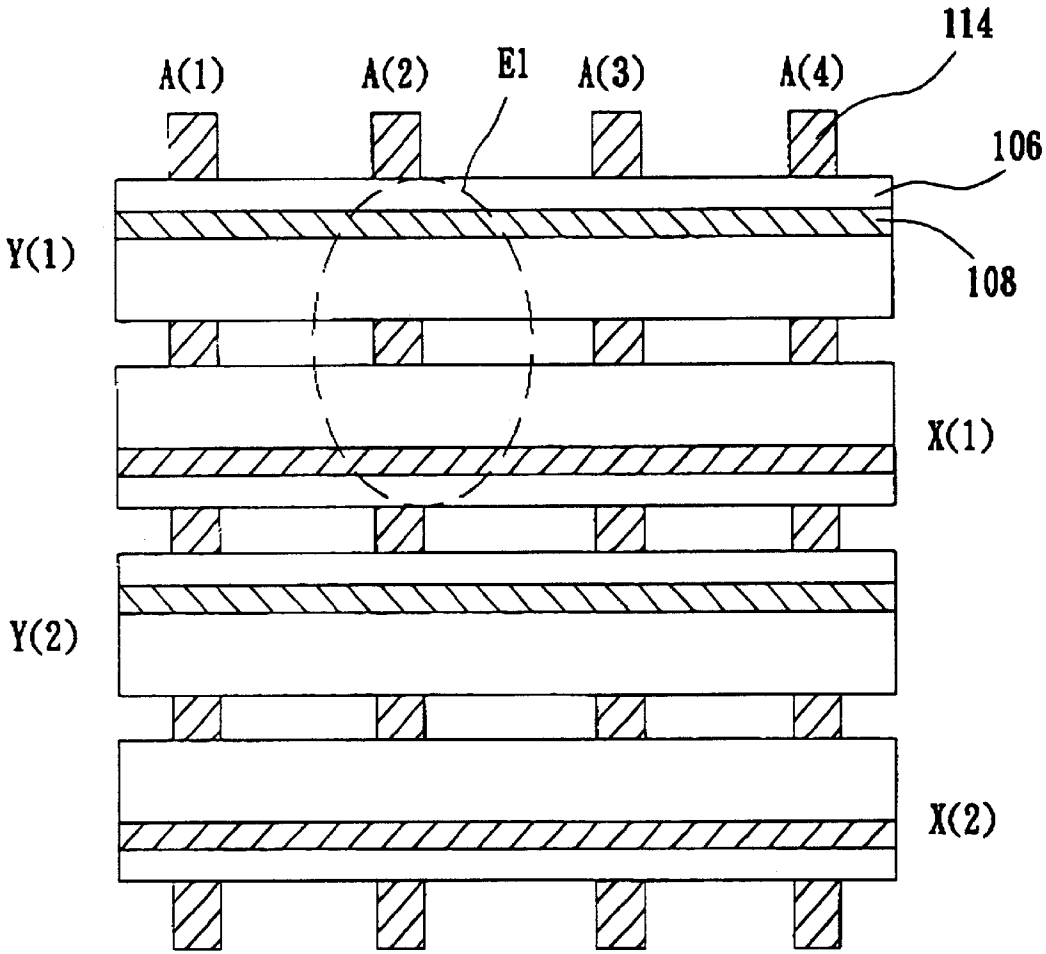
FIG. 2 (PRIOR ART)
FIG. 2 is the diagram of the electrode arrangement for the YXYX-type according to the conventional PDP.
Figure 3:
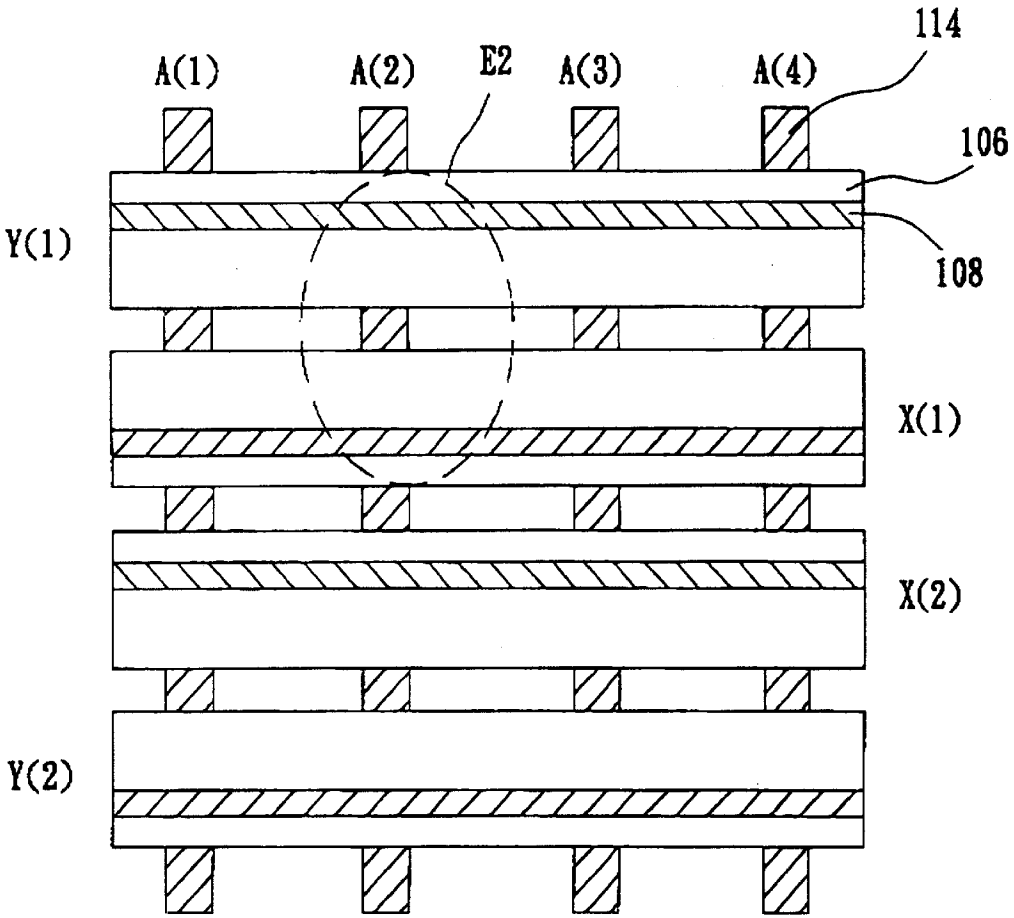
FIG. 3 (PRIOR ART)
FIG. 3 is the diagram of the electrode arrangement for the YXXY-type according to the conventional PDP.
Figure 4:
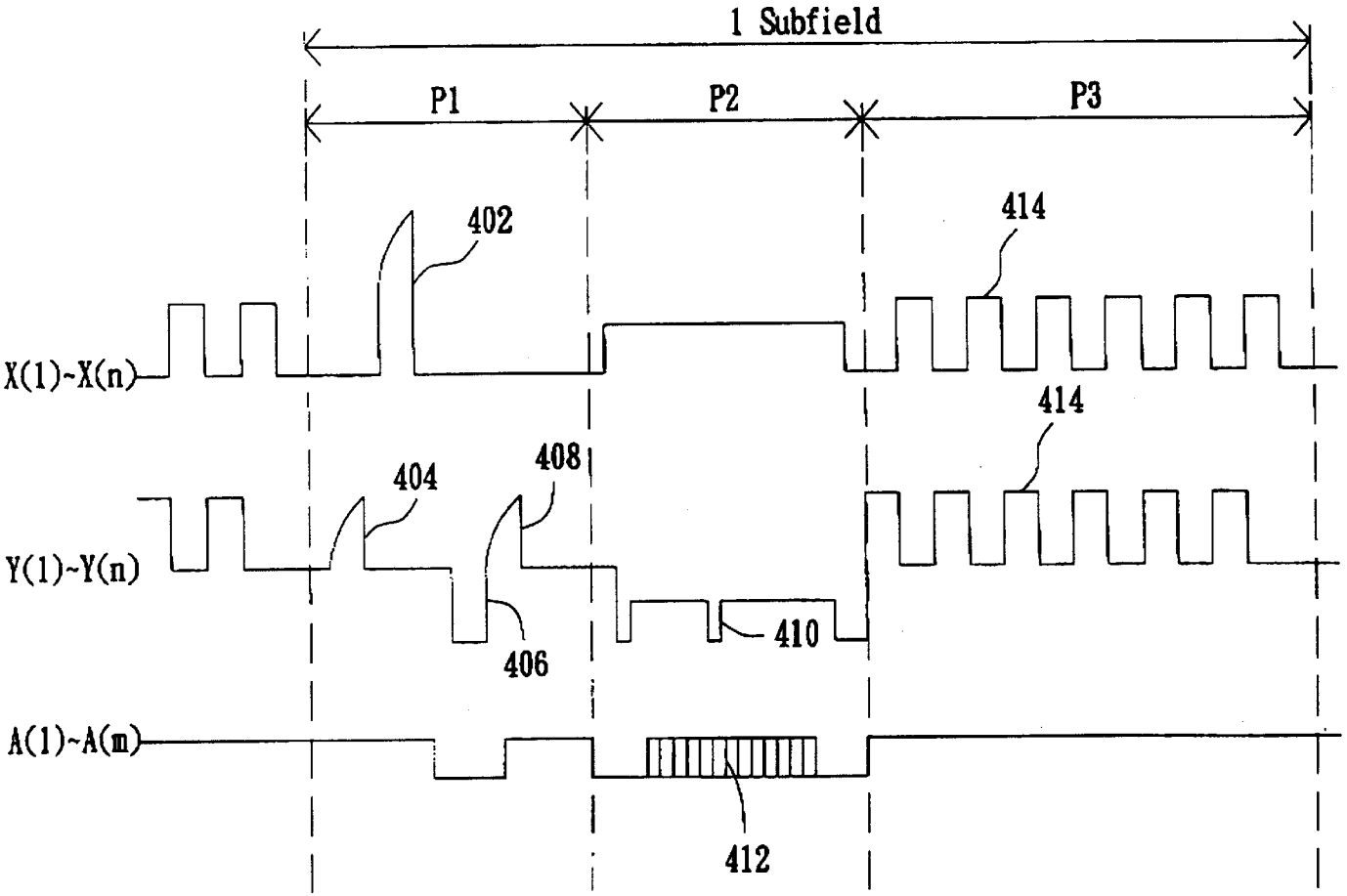
FIG. 4 (PRIOR ART)
FIG. 4 is the diagram of the driving waveform used to drive the conventional PDP in FIG. 2 or FIG. 3.
Figure 5:
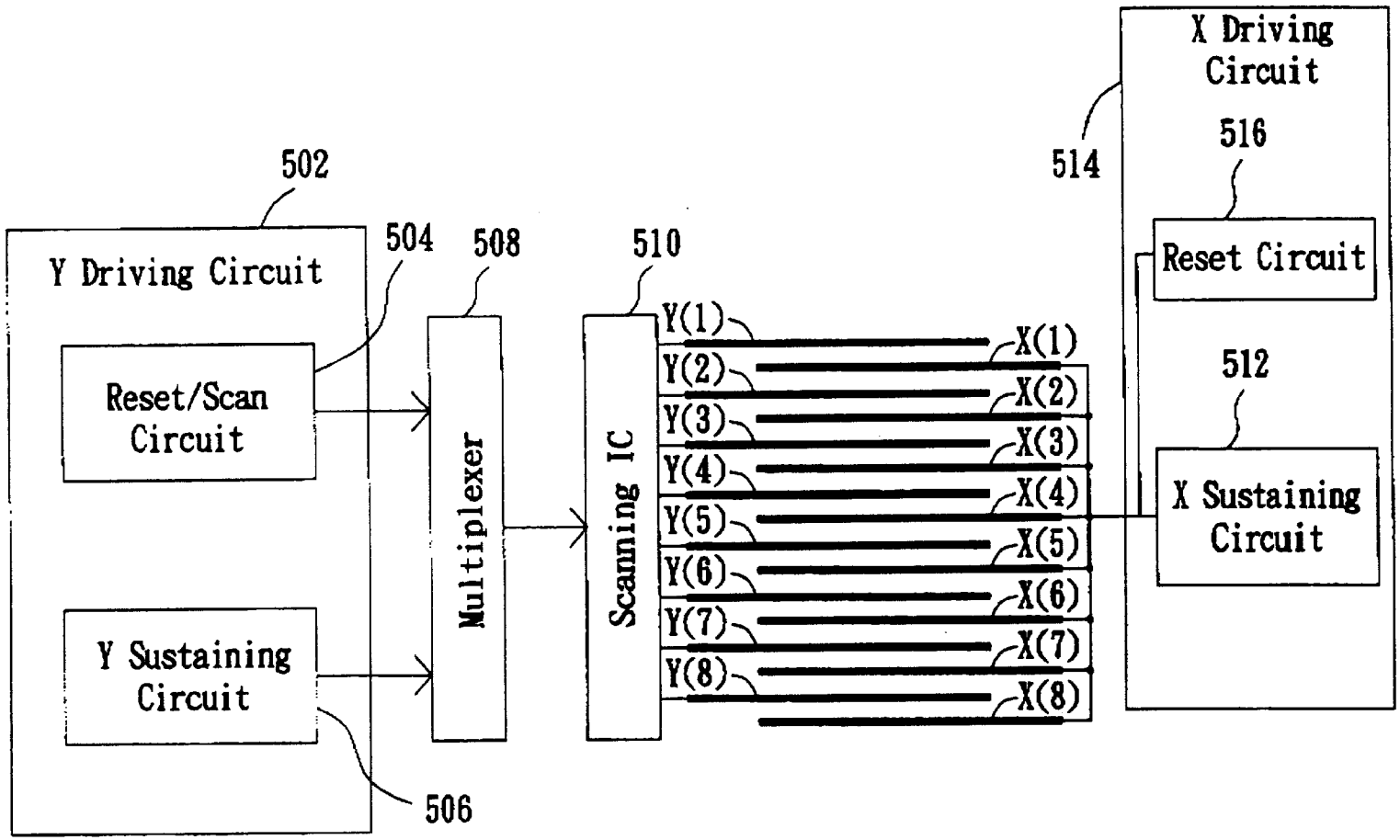
FIG. 5 (PRIOR ART)
FIG. 5 is the block diagram of the circuit used to drive the conventional PDP in FIG. 2 or FIG. 3.
Figure 6:
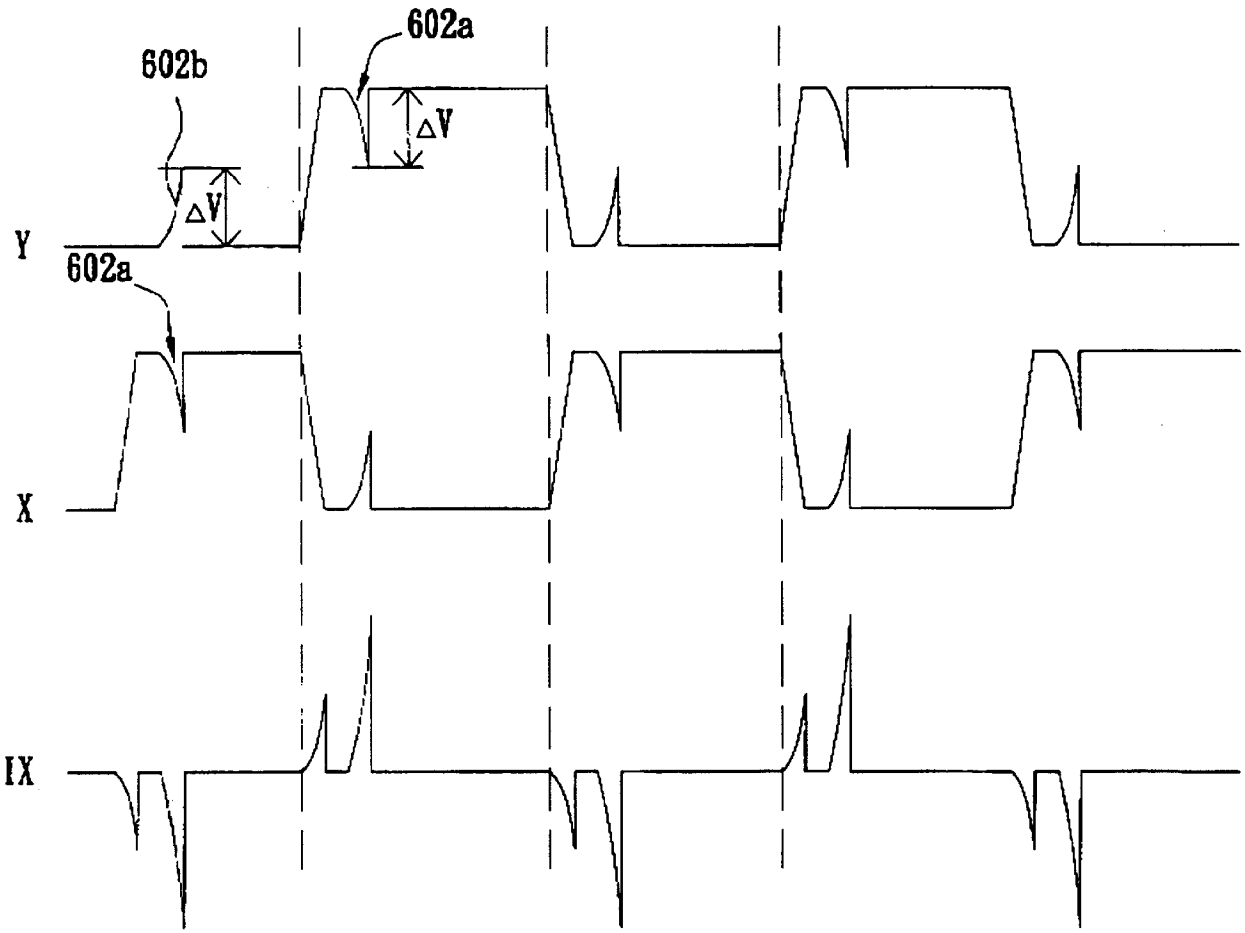
FIG. 6 (PRIOR ART)
FIG. 6 shows the waveforms of the current IX for the sustaining electrode X and the voltage for the sustaining electrode X and the scanning electrode Y during the sustain period P3 in FIG. 4.
Figure 7:
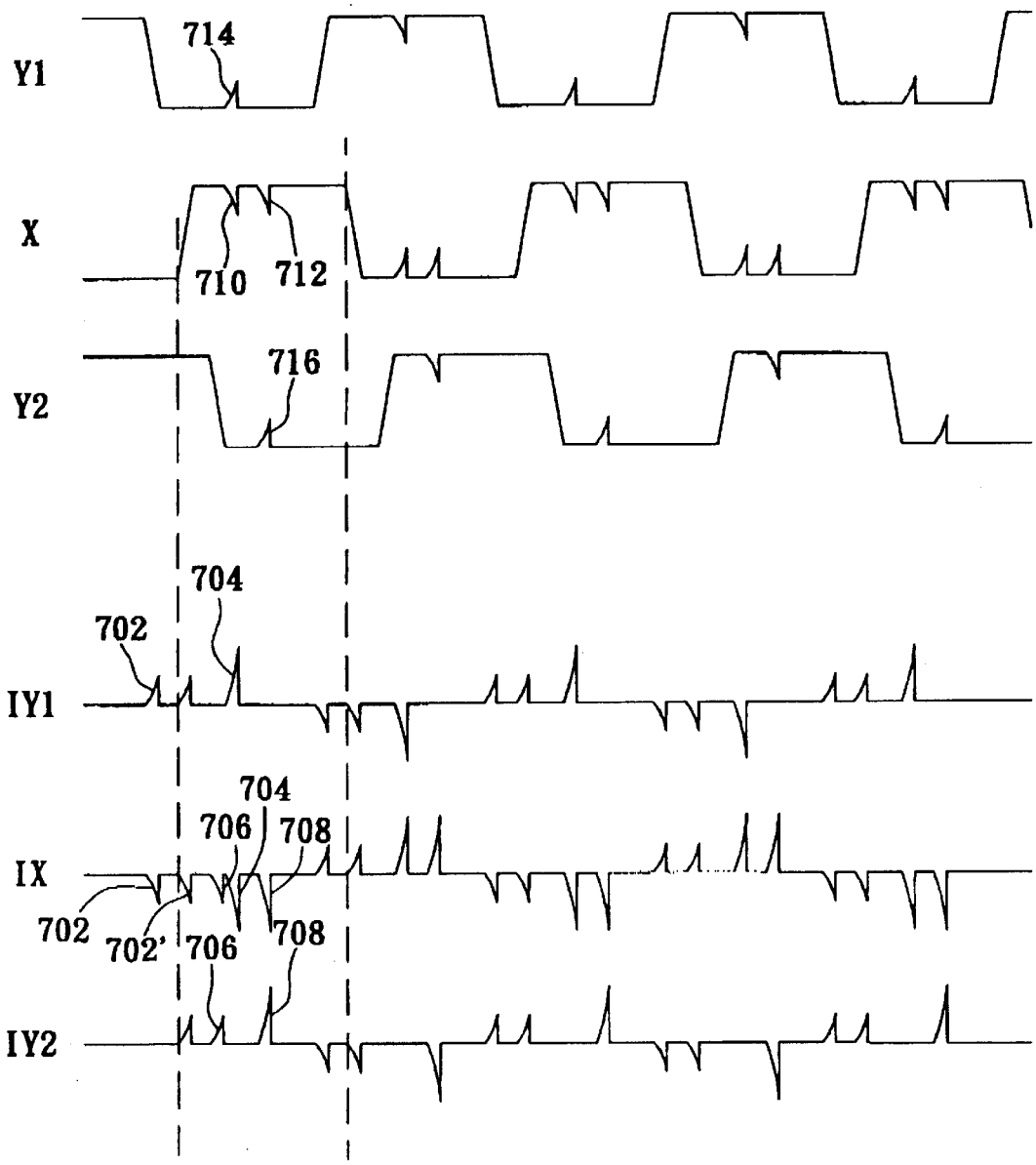
FIG. 7 (PRIOR ART)
FIG. 7 shows the voltage and the current waveforms for the sustaining electrode X and the scanning electrode Y according to the method for driving the PDP in U.S. Pat. No. 6,072,449.
Figure 8:
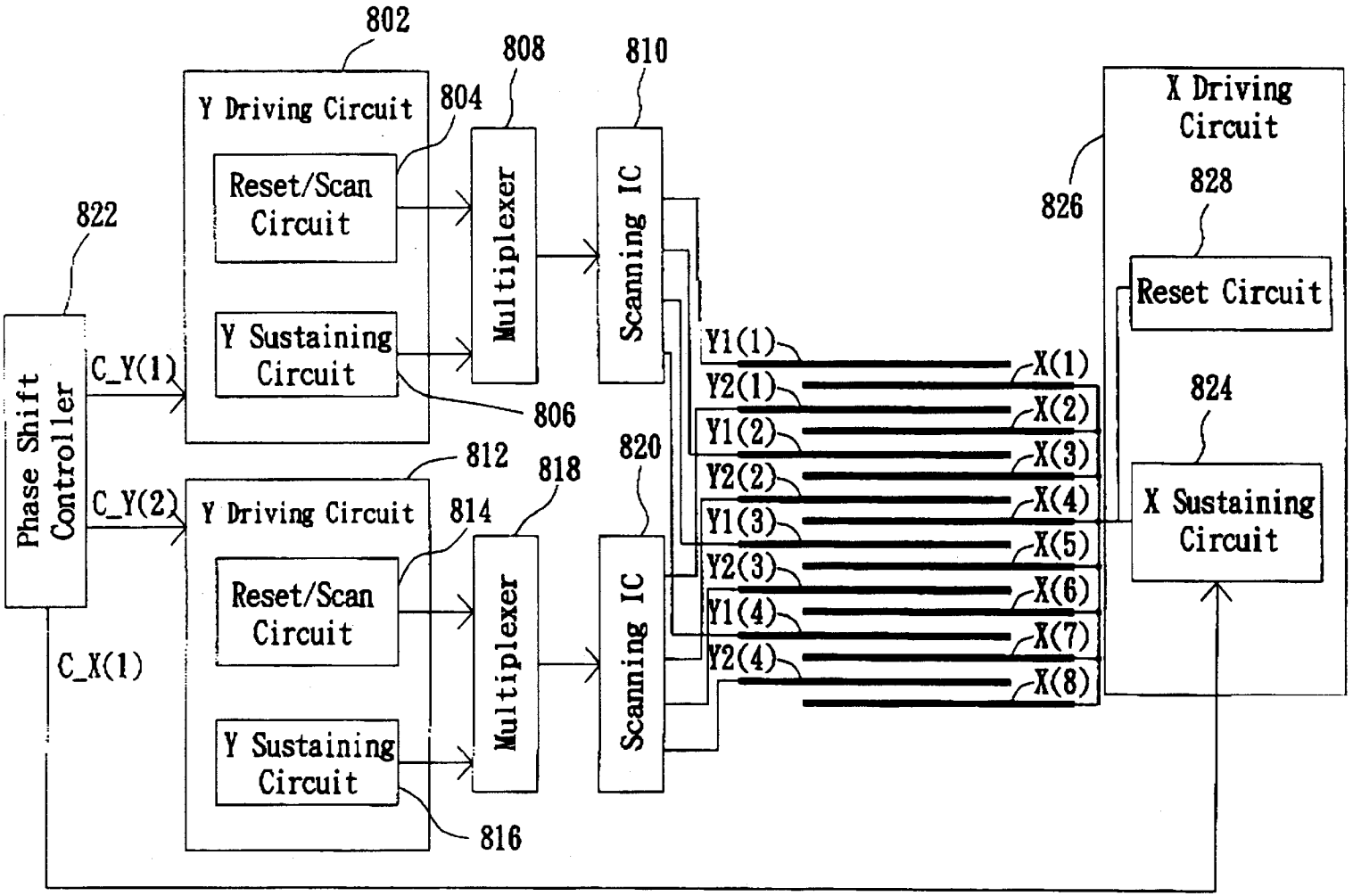
FIG. 8 (PRIOR ART)
FIG. 8 shows the block diagram of a circuit for forming the waveform in FIG. 7.
Figure 12B:
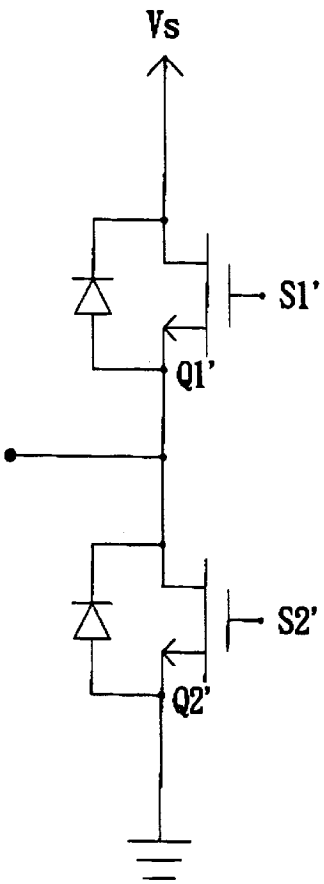
FIG. 12B shows a part of the first X sustaining circuit according to the driving circuit of FIG. 10 in the present invention.
Figure 12A:
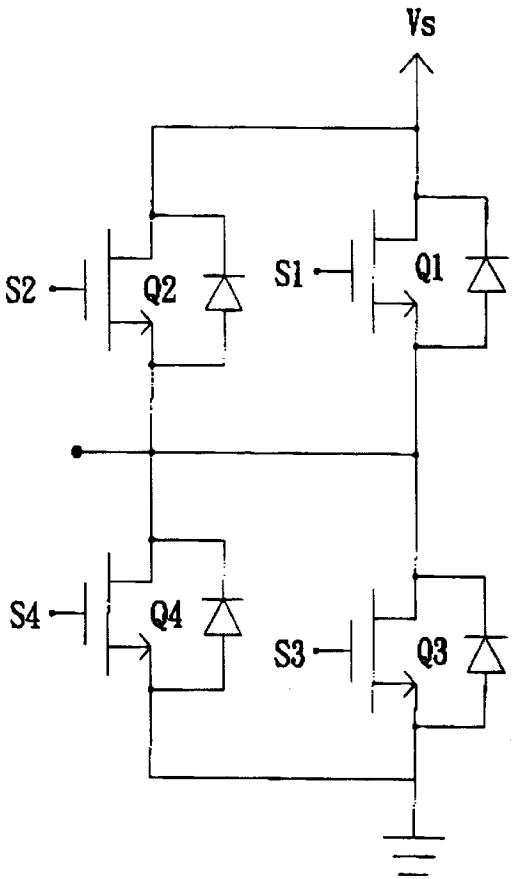
FIG. 12A shows a part of the X sustaining circuit according to the conventional method in FIG. 8.

Please refer to FIGS. 12A and 12B. FIG. 12A shows a part of the conventional X sustaining circuit 824 in FIG. 8, and FIG. 12B shows a part of the first X sustaining circuit 1002 of FIG. 10 in the present invention. In FIG. 12A, the conventional X sustaining circuit 824 must use at least 4 transistors Q1, Q2, Q3, and Q4, which are controlled by control signals S1, S2, S3, and S4 to provide the currents to all the sustaining electrodes X. In the present invention, the sustaining electrodes X are divided into two groups, only two transistors Q1' and Q2', controlled by the control signals S1', S2', are used to drive the first sustaining electrode X1 because the number of the first sustaining electrode X1 is reduced. The total transistors of the first X sustaining circuit 1002 and the second X sustaining circuit 1004 are the same as that in the conventional X sustaining circuit 824 although two sustaining circuits are used in the present invention. Therefore, the number of the transistors for driving the sustaining electrode X will not be increased.

Figure 13:
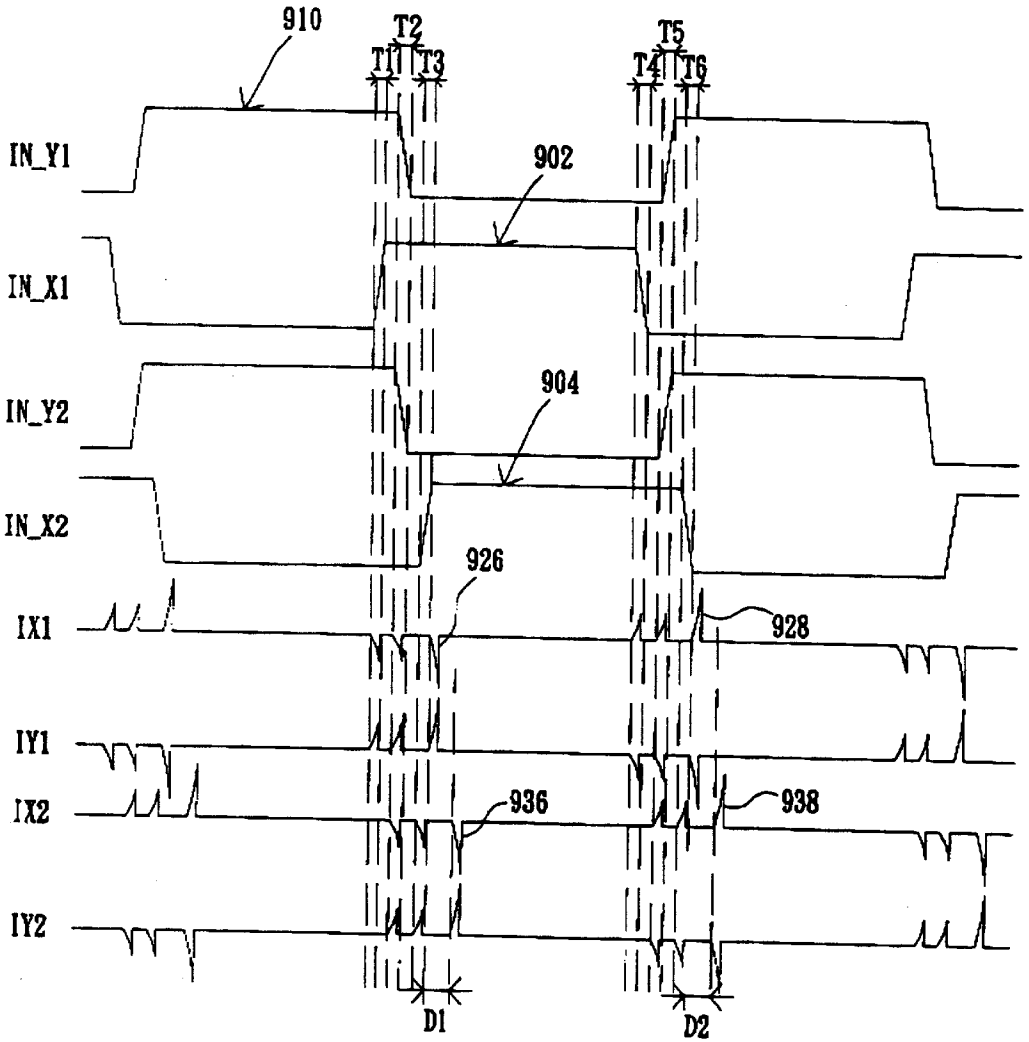
FIG. 13 shows the enlargement of a part of the waveform in FIG. 9.

Please refer to FIG. 13, it shows the enlargement of the waveforms in FIG. 9. The scanning signals IN_Y1 and IN_Y2, the sustaining signals IN_X1 and IN_X2, the current signals IX1, IX2, IY1, IY2 are further explained below.

The sustain period P3 is further divided into several periods. During a period T1, a sustaining voltage is provided to the first sustaining electrode X1, for example, the voltage of the first sustaining electrode X1 is raised from 0V to a high voltage of 180V. At the same time, the second sustaining electrode X2, the first scanning electrode Y1, and the second scanning electrode Y2 are maintained at constant voltages. The second sustaining electrode X2 is maintained at a first voltage, such as a low voltage of 0V. The first scanning electrode Y1 and the second scanning electrode Y2 are maintained at a scanning voltage, such as a high voltage of 180V.

During a period T2, the voltages of the first scanning electrode Y1 and the second scanning electrode Y2 are reduced from the scanning voltage to a second voltage. The second voltage is a low voltage, for example, the voltages of these electrodes are reduced from 180V to 0V. The first sustaining electrode X1 and the second electrode X2 are maintained at the sustaining voltage and the first voltage, respectively. After this period T2, the plasma between the first scanning electrode Y1 and the first sustaining electrode X1 is triggered and a first discharge current 926 is produced because the voltage difference between the first scanning electrode Y1 and the first sustaining electrode X1 is larger than a threshold voltage.

During a period T3, a sustaining voltage is provided to the second sustaining electrode X2. The voltage of the second sustaining electrode X2 is increased from 0V to 180V. At the same time, the first scanning electrode Y1 and the second scanning electrode Y2 are remained at the second voltage (0V). The first sustaining electrode X1 still maintains at the sustaining voltage (180V). After the period T3, the plasma between the second scanning electrode Y2 and the second sustaining electrode X2 is triggered and the second discharge current 936 is produced. The second discharge current 936 is produced after the first discharge current 926 is produced for a delay time D1. The first and second discharge currents are not occurred at the same time, so the instant power consumption of the PDP may be reduced.

Generally, the first discharge current 926 appears after a delay of 0.5~1ì s from the end of the period T2 and the second discharge current 936 appears after a delay of 0.5~1ì s from the end of the period T3 in FIG. 13.

Then, during a period T4, the voltage of the first sustaining electrode X1 is reduced from the sustaining voltage to a third voltage. The third voltage is a low voltage, such as 0V.

At the same time, the first scanning electrode Y1 and the second scanning electrode Y2 are maintained at the second voltage (0V), and the second sustaining electrode X2 is maintained at the sustaining voltage (180V) during the period T4. Similarly, during a period T5, the voltages of the first scanning electrode Y1 and the second scanning electrode Y2 are increased to the scanning voltage, such as 180V. The first sustaining electrode X1 and the second sustaining electrode X2 are maintained at the third voltage and the sustaining voltage during the period T5, respectively. During a period T6, the voltage of the second sustaining electrode X2 is reduced to a fourth voltage. The fourth voltage is a low voltage, the voltage of the second sustaining electrode X2 is reduced from the high voltage of 180V to the low voltage of 0V. The first sustaining electrode X1 is maintained at the third voltage (0V), the first scanning electrode Y1 and the second scanning electrode Y2 are remained at the scanning voltage (180V) during the period T6. Therefore, a third discharge current 928 having an opposite phase to the first discharge current 926 is produced on the first sustaining electrode X1. A fourth discharge current 938 with an opposite phase to the second discharge current 936 is also produced on the second sustaining electrode X2. A delay time D2 is happened during the third discharge current 928 and fourth discharge current 938.

Figure 14:
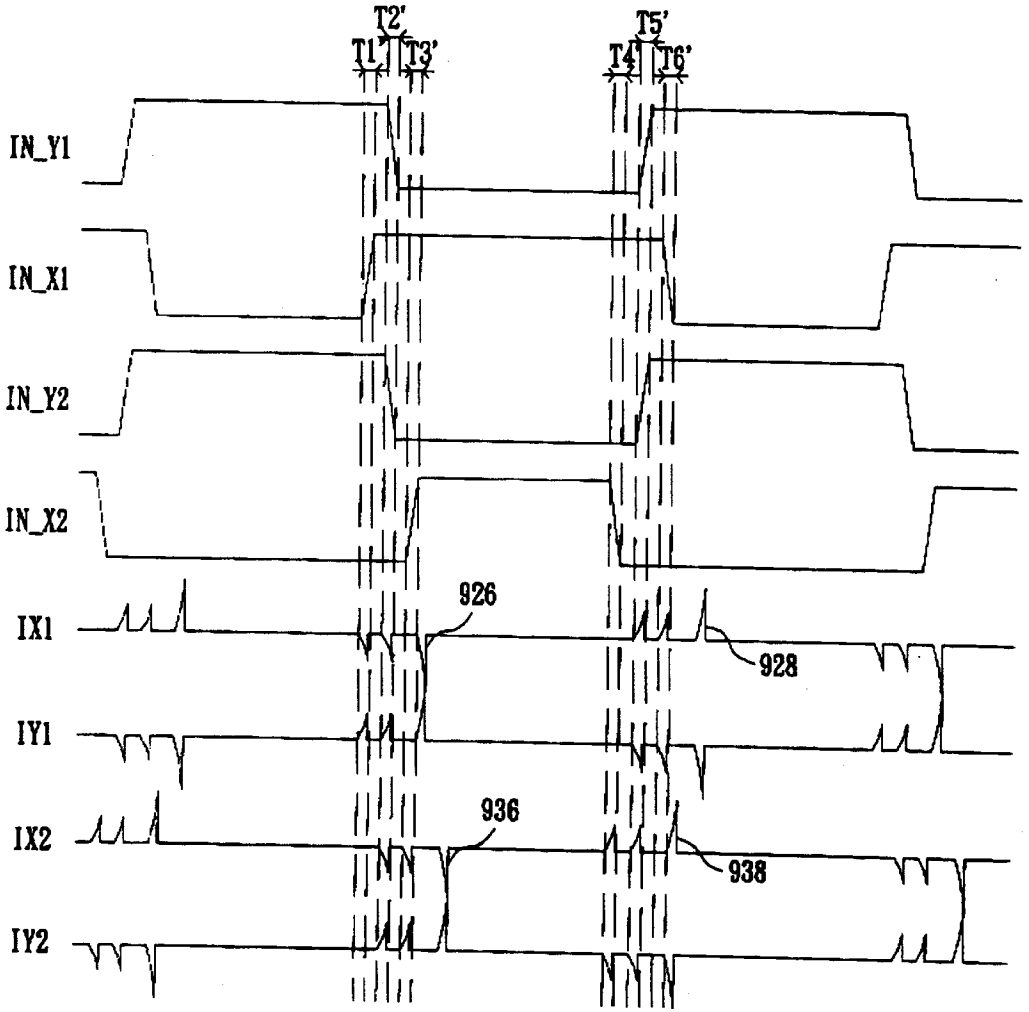
FIG. 14 shows the sustain discharge waveform according to the second embodiment in the present invention.

Please refer to FIG. 14, it shows another sustain discharge waveform according to the second embodiment in the present invention. During the period T1', T2' and T3', the variation of the voltages of the first sustaining electrode X1, the second sustaining electrode X2, the first scanning electrode Y1 and the second scanning electrode Y2 are the same as that during the first, second, third periods T1, T2, and T3 in FIG. 13. In the periods T4', T5', and T6', the voltage variations of these electrodes are different. During the period T4', the first sustaining electrode is maintained at the sustaining voltage (180V), but the voltage of the second sustaining electrode X2 is reduced to a low voltage such as 0V. At the same time, the first scanning electrode Y1 and the second scanning electrode Y2 are maintained at the low voltage of 0V.

Next, during a period T5', the first scanning electrode Y1 and the second scanning electrode Y2 are increased to the scanning voltage (180V). At the same period, the voltages of the first sustaining electrode X1 and the second sustaining electrode X2 are maintained at the sustaining voltage (180V) and the low voltage (0V), respectively. Similarly, during a period T6', the first sustaining electrode X1 is decreased to the low voltage such as 0V. The voltages applied to the second sustaining electrode X2, the first scanning electrode Y1 and the second scanning electrode Y2 maintain at constant values (0V, 180V, 180V) during the period T6'. Therefore, the third discharge current 928, having an opposite phase to the first discharge current 926, is produced on the second sustaining electrode X2. And the fourth discharge current 938 with the opposite phase to the second discharge current 936 is produced on the first sustaining electrode X1.

Figure 15:
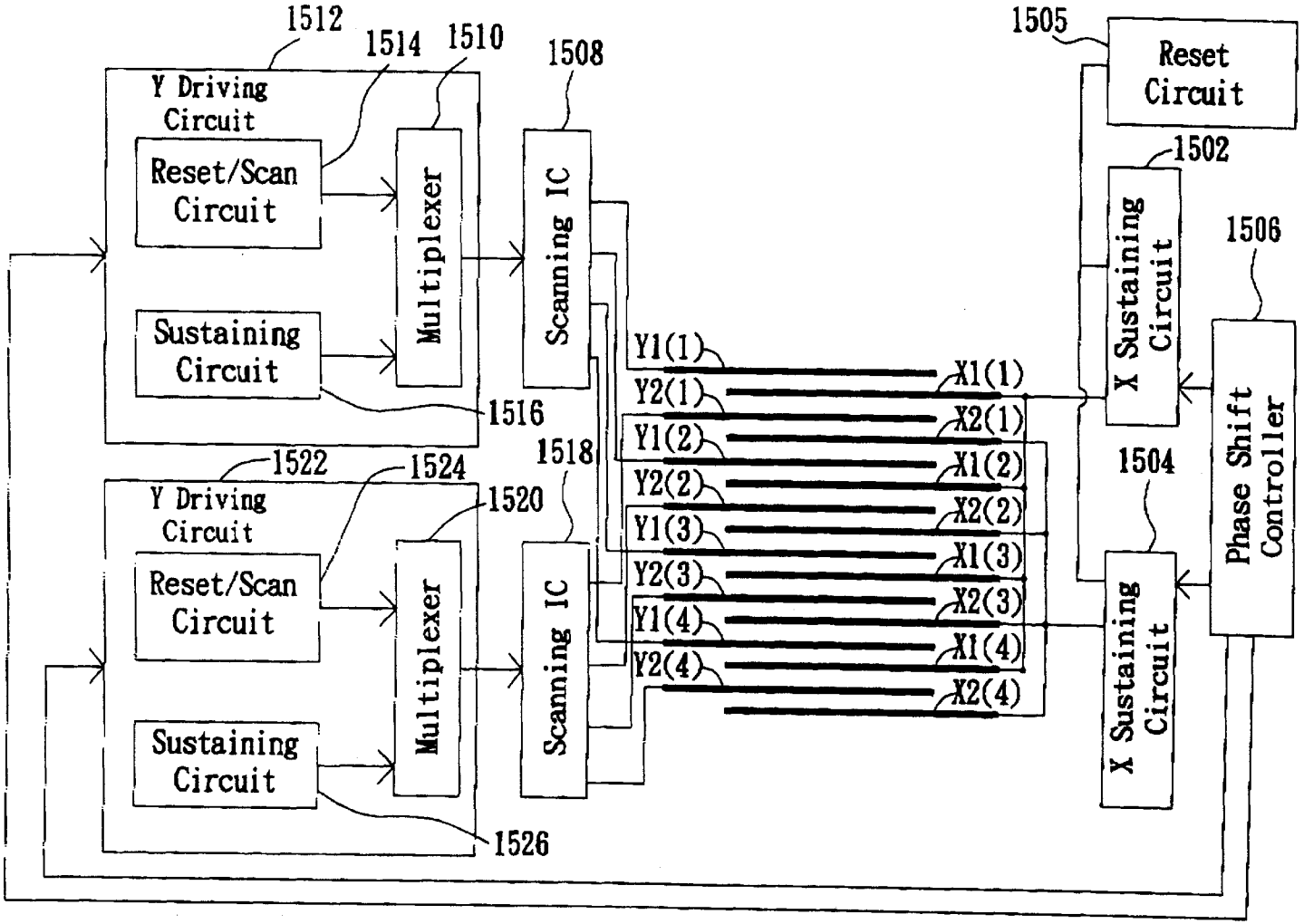
FIG. 15 shows block diagram of a driving circuit using two different scanning ICs.

All scanning electrodes Y are connected to one scanning IC 1008 or 1108 as shown in FIG. 10 or FIG. 11. However, it will not limit the scope of the present invention. In FIG. 15, it shows block diagram of another driving circuit for the PDP. These scanning electrodes are divided into two groups, including a first scanning electrode Y1 and a second scanning electrode Y2, and coupled to different scanning ICs. The first scanning electrode Y1 is coupled to the scanning IC 1508, and the second scanning electrode Y2 is coupled to the scanning IC 1518. The sustain Y driving circuit 1512 includes a reset/scan circuit 1514, a sustaining circuit 1516, and a multiplexer 1510. The Y driving circuit 1522 includes a reset/scan circuit 1524, a sustaining circuit 1526, and a multiplexer 1520. The scanning IC 1508 and 1518 are coupled to the multiplexer 1510, 1520, respectively. The first sustaining electrode X1 is coupled to the X sustaining circuit 1502 and the second sustaining electrode X2 is coupled to the X sustaining circuit 1504. The phase shift controller 1506 is coupled to the X sustaining circuit 1502, X sustaining circuit 1504, the sustain Y driving circuit 1512 and Y driving circuit 1522. The scanning IC 1508 and the scanning IC 1518 output the third discharge sustaining pulse and the fourth discharge sustaining pulse. The phases of the third sustain discharge and the fourth sustain discharge can be the same or different.

Based on the scope of the present invention, the sustaining electrode X can be divided into N set, and N>2. As long as the phases of the discharge sustaining pulses applied to the N set electrodes are different, the purpose of the present invention is achieved.

From the above description, the driving method and circuit of the sustaining electrode in the present invention can reduce the voltage notch effectively, increase the operation margin, and reduce the electromagnetic interference of the PDP. And the purpose in the present invention is achieved with a simple circuit.

Once given the above disclosure, many other features, modifications, and improvements will become apparent to the skilled artisan. Such other features, modifications, and improvements are, therefore, considered to be a part of this invention, the scope of which is to be determined by the following claims.

What is claimed is:

1. A method of driving a plasma display panel (PDP), said PDP comprising a first sustaining electrode, a second sustaining electrode, a scanning electrode, and a data electrode, said scanning electrode being parallel to said first sustaining electrode and said second sustaining electrode, said data electrode being perpendicular to said scanning electrode, the driving method comprising the steps of:

providing an address period;

applying a scanning pulse to said scanning electrode during said address period and selectively applying a data pulse to said data electrode for writing in image data;

providing a sustain period; and applying a first pulse and a second pulse with different phases to said first sustaining electrode and said second sustaining electrode during the sustain period, and applying a third pulse between the applications of the first pulse and the second pulse during the sustain period to said scanning electrode for maintaining said image data, wherein said first pulse and said second pulse produce a first discharge current and a second discharge current on said first sustaining electrode and said second sustaining electrode, and a time interval is formed between the production of said second discharge current and the production of said first discharge current, to reduce an instant power consumption of said PDP.

2. A method of driving a plasma display panel (PDP), said plasma display panel comprising a scanning electrode, a first sustaining electrode, and a second sustaining electrode, the driving method comprising the steps of:

(a) during a first period, increasing a voltage on said first sustaining electrode to a sustaining voltage, maintaining said second sustaining electrode at a first voltage, and maintaining said scanning electrode at a scanning voltage;

(b) during a second period, dropping a voltage of said scanning electrode from said scanning voltage to a second voltage, and maintaining said first and second sustaining electrodes at said sustaining voltage and said first voltage; and (c) during a third period, increasing a voltage of said second sustaining electrode from said first voltage to said sustaining voltage, maintaining said second sustaining electrode as said sustaining voltage, and maintaining said scanning electrode at said second voltage;

wherein a first discharge current is produced on said first sustaining electrode, a second discharge current is produced on said second sustaining electrode, and a first delay time is formed between the production of said first discharge current and the production of said second discharge current, so as to reduce an instant power consumption of said PDP.

3. The method of claim 2, further comprising the steps of:

(d) during a fourth period, dropping said voltage of said first sustaining electrode from said sustaining voltage to a third voltage, maintaining said second sustaining electrode at said sustaining voltage, and maintaining said scanning electrode at said second voltage;

(e) during a fifth period, increasing said voltage of said scanning electrode to said scanning voltage, maintaining said first and second sustaining electrodes at said third voltage and said sustaining voltage, respectively; and (f) during a sixth period, dropping said voltage of said second sustaining electrode from said sustaining voltage to a fourth voltage, maintaining said first sustaining electrode at said third voltage, and maintaining said scanning electrode as said scanning voltage;

wherein a third discharge current is produced on said first sustaining electrode, a fourth discharge current is produced on said second sustaining electrode, said first and third discharge currents are in contrary phases, said second and fourth discharge currents are in contrary phases, and a second delay time is formed between the production of said third the discharge current and the production of said fourth discharge current.

4. The method of claim 2, further comprising (d') during a fourth period, dropping said voltage of said second sustaining electrode from said sustaining voltage to a third voltage, maintaining said first sustaining electrode at said sustaining voltage, and maintaining said scanning electrode at said second voltage;

(e) during a fifth period, increasing said voltage of said scanning electrode to said scanning voltage, respectively maintaining said first and second sustaining electrodes at said sustaining voltage and said third voltage; and (f) during a sixth period, dropping said voltage of said first sustaining electrode from said sustaining voltage to a fourth voltage, maintaining said second sustaining electrode at said third voltage, and maintaining said scanning electrode as said scanning voltage;

wherein a third discharge current is produced on said second sustaining electrode, a fourth discharge current is produced on said first sustaining electrode, said second and third discharge currents are in contrary phases, said first and fourth discharge currents are in contrary phases, and a second delay time is formed between the production of said third discharge current and the production of said fourth discharge current.

5. A circuit of driving a plasma display panel (PDP), said PDP comprising a scanning electrode Y, a first sustaining electrode X1, a second sustaining electrode X2 and a data electrode, said driving circuit comprising:

a Y driving circuit;

a scanning IC coupling with said scanning electrode and said Y driving circuit;

a first X sustaining circuit coupling to said first sustaining electrode X1 and a second X sustaining circuit coupling to said second sustaining electrode X2; and a phase shift controller coupling to said first X sustaining circuit and said second X sustaining circuit, said phase shift controller commanding said first X sustaining circuit and said second X sustaining circuit to output a first and a second pulse, and said first and second pulse being in different phases;

wherein during a sustain period when driving the PDP, the first pulse is applied to the first sustaining electrode X1, the second pulse is applied to the second sustaining electrode X2, and a third pulse outputted from the scanning IC is applied to the scanning electrode Y between the application of the first pulse and the application of the second pulse.

* * * * *